United States Patent [19]

Kallman

[11] 4,236,658

[45] Dec. 2, 1980

[54] SYSTEM FOR HOLDING ARTICLES TO OBJECTS

[75] Inventor: Robert A. Kallman, Brooklyn, N.Y.

[73] Assignee: Kallman Research Corporation, Weatogue, Conn.

[21] Appl. No.: 902,797

[22] Filed: May 4, 1978

[51] Int. Cl.[3] ..... A45C 1/04

[52] U.S. Cl. ..... 224/250; 2/DIG. 6; 24/DIG. 16

[58] Field of Search ..... 224/5 R, 5 V, 5 H, 5 K, 224/5 A, 23, 28 D, 28 P, 45 S, 58, 55; 24/203 R, 204, 3 M, 3 C, 16, DIG. 18, 3 R, 17 A, 17 B; 2/94, 2, DIG. 6; 229/62

[56] References Cited

U.S. PATENT DOCUMENTS

| | | | |
|---|---|---|---|
| 2,260,427 | 10/1941 | Bailey | 2/94 |
| 3,372,438 | 3/1968 | Rinecker | 24/204 |
| 3,383,738 | 5/1968 | Fox et al. | 2/DIG. 6 |
| 3,446,420 | 5/1969 | Rinecker | 24/204 |
| 3,501,774 | 3/1970 | Norman | 2/DIG. 6 |
| 4,002,277 | 1/1977 | Westerholm | 224/459 |
| 4,055,873 | 11/1977 | Kallman | 224/5 K |
| 4,088,136 | 5/1978 | Hasslinger et al. | 224/5 H |

*Primary Examiner*—Stanley H. Tollberg
*Assistant Examiner*—Kenneth Noland
*Attorney, Agent, or Firm*—Darby & Darby

[57] ABSTRACT

An article-holding system for use on objects to hold and support articles which have a vertical component of weight which is otherwise unsupported. This system includes first and second strips, the strips having complementary fabric fasteners thereon with the object being placed adjacent the first strip, the second strip being bent around the object and fastened to the first strip with the second strip also having a free-hanging piece of fabric-fastening material, serving as an anti-peel tab, which is fastened to the first strip.

5 Claims, 6 Drawing Figures

SYSTEM FOR HOLDING ARTICLES TO OBJECTS

RELATED PATENTS AND APPLICATIONS

In my prior U.S. Pat. Nos. 4,051,554 granted Oct. 4, 1977, and 4,055,873 granted Nov. 1, 1977, and my copending application filed on Apr. 17, 1978, Ser. No. 896,803, now U.S. Pat. No. 4,168,544, all of which are assigned to the same assignee, various strap-type systems are disclosed for holding articles of any type, such as goggles, hats, gloves, flashlights, keys, etc., on objects such as articles of clothing, backpacks, vehicles and parts thereof, etc.

The present invention also relates to an article-holding system and particularly one for holding an object which has a component of weight in the vertical direction which is substantially unsupported, except by the holding system itself.

SUMMARY OF THE INVENTION

The present invention relates to a system for holding articles which have an otherwise unsupported vertical component of weight. The system includes first and second strips having complementary pieces of fabric-fastening material, such as so-called VELCRO material, thereon. One of the strips has, for example, VELCRO brush or loop-type material and the other has pieces of hook material. One of the strips is fastened to the object to which the article is to be held. The second strip is attached at a point along the length of the first strip. The article to be held is placed adjacent the first strip and the second strip is bent around the article and its fabric-fastening material fastened to that of the first strip. The fabric-fastening material of the second strip also includes a free-hanging tab which is fastened to the fabric-fastening material on the first strip to act as an anti-peel tab. This provides a firm holding action so that a relatively large amount of weight can be supported by the system without the strips becoming separated.

OBJECTS OF THE INVENTION

It is an object of the invention to provide an article-holding system using two strips having complementary types of fastening material, thereon.

A further object is to provide a system for holding articles having a substantially unsupported component of vertical weight.

Another object is to provide an article-holding system whereby two strips have pieces of fabric-fastening material of a complementary type thereon with one of the strips having a piece of fabric-fastening material which is free-hanging and which acts as an anti-peel tab.

Other objects and advantages of the present invention will become more apparent upon reference to the following specification and annexed drawings in which.

Figure 1:
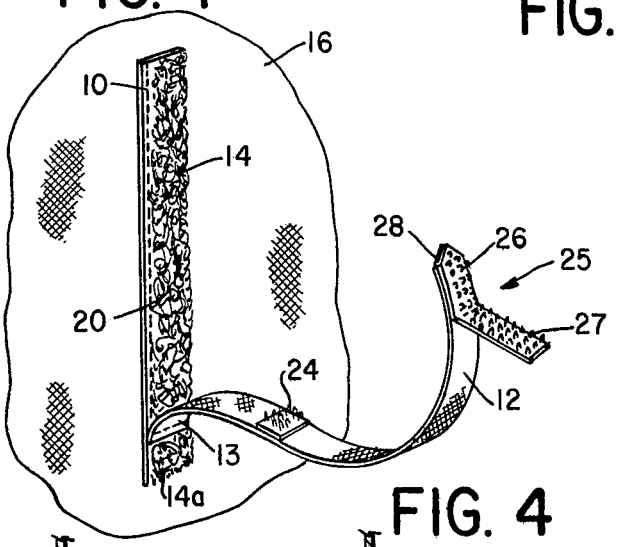
FIG. 1 is a perspective view of the article-holding system with the system shown in an unfastened condition ready to accept an article.
Figure 2:
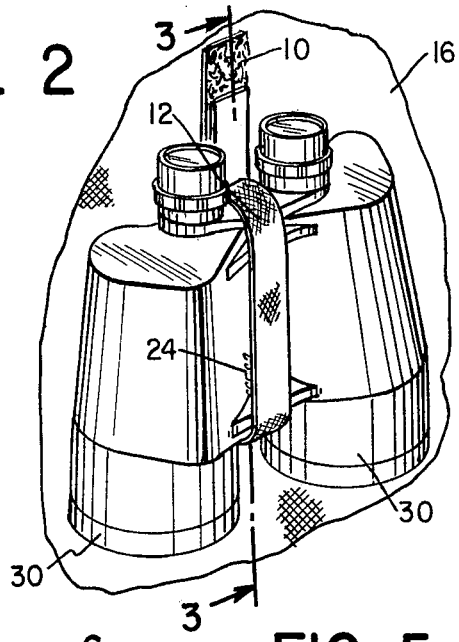
FIG. 2 is a perspective view of the system of FIG. 1 used for holding a pair of binoculars.
Figure 3:
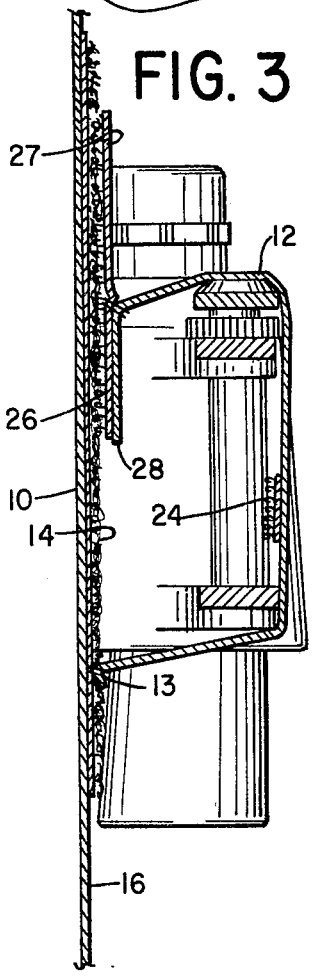
FIG. 3 is a side view of the system, taken in section, along lines 3—3 of FIG. 2.

Referring to FIGS. 1–3, the article-holding system includes first and second strips 10 and 12 which can be of any suitable material, for example of fabric, etc. The first strip 10 is preferably inelastic and has on one surface thereof fabric-fastening material 14. In a typical embodiment of the invention, the fabric-fastening material 41 is of the VELCRO type. Also, as illustrated, the material 14 is of brush or loop, type VELCRO although the complementary type could be used if suitable modification is made. The material 14 is shown along the entire length of strip 14 although, of course, it could be placed thereon in segments.

Strip 10 is shown attached, along its length to an object 16 by any suitable means. The orientation of strip 10 is generally vertical with respect to the normal orientation of object 16. That is, if object 16 is a jacket, strip 10 is placed lengthwise. In FIG. 1, strip 10 is shown as being attached by stitching 20 around its periphery. It should be understood that any suitable fastening arrangement can be utilized, for example, adhesive, heat-sealing, etc., depending upon the type of material of strip 10 and the underlying object 16. It should also be understood that the object 16 can be of any suitable type, for example, an article of clothing such as a shirt, jacket or pants, a knapsack or a backpack, the side of any structure or vehicle, a wall, etc. The type of material 10 and the fastening arrangement 20 generally depends upon the underlying base portion 16.

The length of the second strip 12 is selected depending upon the size of the article to be held. In general, it is preferably made several inches longer than the first strip 10. One end 13 of the second strip 12 is attached to the first strip 10 at point 22, this being shown by stitch lines. It should be understood that piece 12 can be attached directly to piece 10 so that the system will comprise an integral structure or else strip 12 can be provided separately and later attached both to the first strip 10 and also to the underlying base object 16. A piece 14*a* of fastening material extends below attachment point 22, for a purpose described below.

Two pieces 24 and 25 of fabric-fastening material of a type complementary to that of material 14 are attached to the second strip 12. These two pieces can be, for example, of VELCRO hook-type material. The first piece 24 is attached to the inside face of the second strip 12, i.e., the face opposing the outer face 14 of strip 10, at a point intermediate its two ends 13 and 28. Piece 24 is used primarily for storage of the second strip 12.

The second piece 25 is attached to the outer face of strip 12 adjacent the end 28 on the face of strip 12 remote from the outer face of strip 10. Piece 25 includes a first portion adjacent strip end 28 which is fixedly attached to the strip and a free-hanging tab portion 27 which is not attached to the strip. The relative size of the pieces 26 and 27 are not critical. However, piece 26 should be made sufficiently long to serve a holding function, as is described below.

The use of the system is described with reference to FIGS. 1–3. As shown, the article to be held, here illustratively a pair of binoculars 30, is placed adjacent the object 16 next to the first strip 10. Second strip 12 is bent around the binoculars, as shown, over the nosepiece, and the first, fixed, piece 26 of fabric-fastening material of the second type fastened to the fabric-fastening material 14 of the first strip 10.

If the object 30 were light in weight, the holding action between the complementary fabric-fastening material pieces 14 and 26 would be sufficient to provide a relatively firm grip. However, if the object is relatively heavy, what occurs is that the vertical component of the weight of the object, which is unsupported, would cause the piece 26 to peel away from the underlying piece 14 thereby breaking the hold and causing the two strips 10,12 to separate. To prevent this, the tab 27, which also has a fabric-fastening material of the second type thereon, is also fastened to the material 14 above the piece 26. This provides a firm hold or an anti-peel tab. That is, due to the presence of the tab 27, the component of force produced by the weight of the object 30 which would normally act outwardly at the upper end of piece 26 to tend to peel strip 12 away from strip 10 is taken up by the tab 27 since this extends above the point where such force component is produced. Thus, a secure hold is produced between the two strips.

Figure 4:
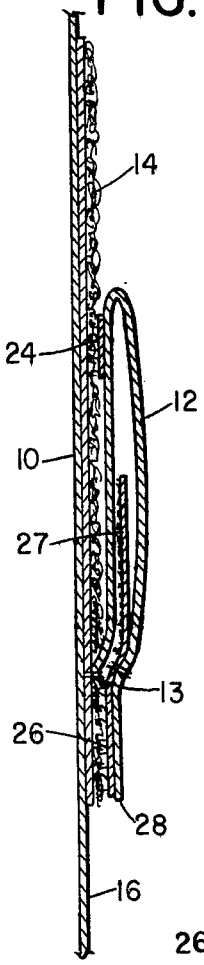
FIG. 4 is a side view similar to that of FIG. 3, taken partly in section, showing the system in a storage condition.

FIG. 4 shows the system in a storage position. As seen, the strip 12 is bent outwardly, away from, the strip 10 above the piece 24. Piece 24 is then fastened to piece 14. The piece of fabric-fastening material of the second type 26 is then attached to the piece 14*a* of the first type below the attachment point 22. Thus, the strip 12 is stored when not in use so that it does not hang free.

Strip 12 can be either of inelastic or elastic material. In the latter case, in some applications, it is desirable to have a strip 12 which can be elongated to hold larger objects.

Figure 5:
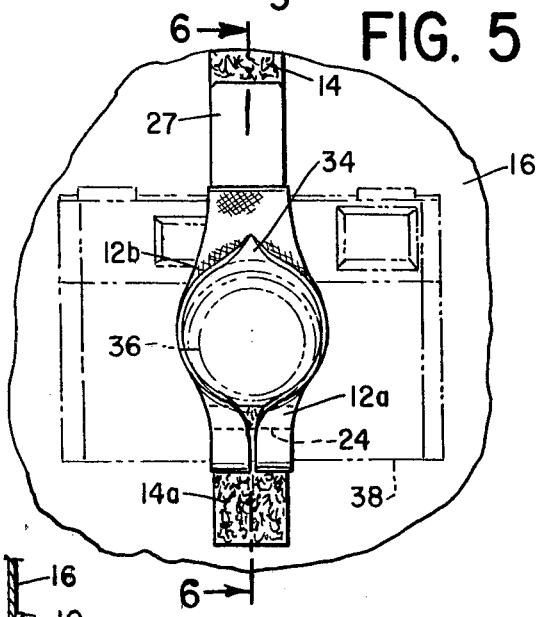
FIG. 5 is a front view of a further embodiment of the invention.
Figure 6:
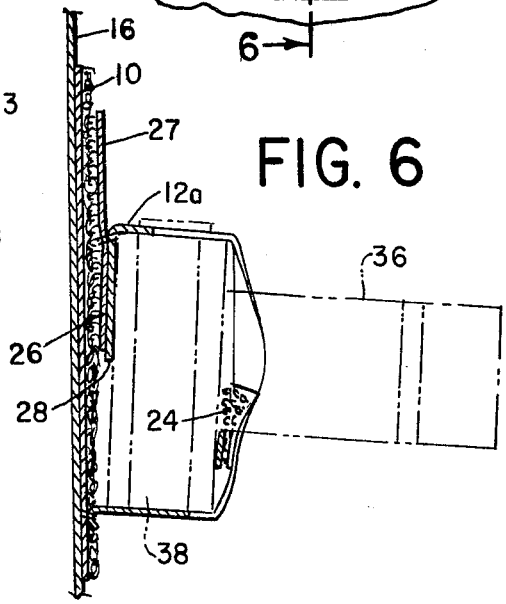
FIG. 6 is a side view of FIG. 5 taken partly in cross-section along lines 6—6.

FIGS. 5 and 6 show a further embodiment of the invention adapted to hold articles having protruding portions, such as a camera with a lens. The difference between the system of FIGS. 5–6 and that of FIGS. 1–3 is that the strip 12 is slit along a part of its length, between end 13 and the piece 26, forming two parts 12*a*, 12*b*, thereby forming an aperture 34 through which the lens barrel 36 of the camera 38 can extend. As seen in FIGS. 5 and 6, the back portion of the camera rests against the first strip 10 and the object 16. The camera 38 tilts forward slightly. Here again, the anti-peel tab 27 provides a firm-holding action. Storage of the system of FIGS. 5–6 is accomplished as shown in FIG. 4.

As described previously the nature of the pieces of fabric-fastening material can be reversed. That is, piece 14 could be all hooks instead of a brush-type material and pieces 24, 26–27 could be of brush-type material. Alternatively piece 14*a* can be of hook material and piece 26 of brush material with the other pieces being as previously described.

While the system has been shown in FIGS. 1–3 as holding a pair of binoculars 30, it should be understood that other articles can be held, e.g., a gun, flashlight, tools, etc. It also, for example, can be used to support a fishing pole while the fisherman is changing bait, thereby leaving both hands of the fisherman free. The system of FIGS. 5–6 can hold all articles which can be held by the system of FIGS. 1–3 as well as articles with protruding portions.

The strips need not be vertically mounted, although this will be the more typical case. For example, the straps can be placed sideways on the sun visor of a car. They also can be placed on the underside of a closed boat hatch, thereby being generally horizontal and hold a rope, with the strips then being vertical when the hatch is opened.

What is claimed is:

1. A system for holding an article to an object comprising:

an elongated first strip for attachment to said object, said first strip having fastening material of a first type thereon along a substantial portion of its length, an elongated second strip having one end attached at a point along the length of said first strip with its other end being free, said second strip having a first face which is more proximate to the fastening material of the first type of the first strip and a second face which is remote from the fastening material of the first type when the two strips are juxtaposed, said article to be held to be located between said first and second strips with said second strip to be wrapped around said article with said first face of said second strip engaging the article, a piece of fastening material attached to and facing outwardly from said second face of said second strip adjacent said other end and of a second type which is complementary to said first type of said first strip and which is to be attached thereto, said piece having a first portion which is fixed to said second face of said second strip adjacent said other end and a free hanging tab portion which extends toward the central portion of said second strip, both of which portions are to be attached to the fastening material on said first strip when said other end of said second strip is folded around the article to be held with said tab portion being bent away from said second strip and having its free end extending in a direction opposite to said other end of said second strip whereby said tab portion extends the area of attachment of said first and second strips and serves to prevent peeling of the second strip from the first strip.

2. A system as in claim 1 wherein said second strip is slit along a portion of its length between the point of attachment to the first strip and the piece to accommodate a protruding portion of an object through said slit.

3. A system as in claim 1 further comprising a second piece of fastening material of said second type attached to said first face of the second strip intermediate the point of attachment of the second strip to the first strip and the free other end of said second strip whereby the second strip can be attached to the first strip for storage.

4. A system as in claim 3 wherein said second strip is attached to said first strip at a point intermediate the ends of the first type material of said first strip whereby said first portion of said first-named piece of said second strip can be attached to the first type fastening material on said first strip at a point located between said attachment point of said second strip to said first strip and the end of the first strip remote from said point of attachment.

5. A system as in claim 3 wherein said second strip is slit along a portion of its length between the point of attachment to the first strip and the piece to accommodate a protruding portion of an object through said slit.

* * * * *